US012703020B2

(12) United States Patent
Kim et al.

(10) Patent No.: US 12,703,020 B2
(45) Date of Patent: Aug. 11, 2026

(54) FITTING BENDING APPARATUS WITH PINCHING PREVENTIVE FUNCTION

(71) Applicant: DAEHAN PRECISION INDUSTRY CO., LTD., Gyeongsangnam-do (KR)

(72) Inventors: Oh Gon Kim, Busan (KR); Seung Jae Lee, Busan (KR)

(73) Assignee: DAEHAN PRECISION INDUSTRY CO., LTD., Gyeongsangnam-do (KR)

( * ) Notice: Subject to any disclaimer, the term of this patent is extended or adjusted under 35 U.S.C. 154(b) by 291 days.

(21) Appl. No.: 18/555,861

(22) PCT Filed: Dec. 1, 2022

(86) PCT No.: PCT/KR2022/019345
§ 371 (c)(1),
(2) Date: Oct. 17, 2023

(87) PCT Pub. No.: WO2024/005282
PCT Pub. Date: Jan. 4, 2024

(65) Prior Publication Data

US 2025/0073768 A1 Mar. 6, 2025

(30) Foreign Application Priority Data

Jul. 1, 2022 (KR) ..... 10-2022-0081385

(51) Int. Cl.
*B21D 7/02* (2006.01)
*B21D 7/024* (2006.01)

(52) U.S. Cl.
CPC ..... *B21D 7/024* (2013.01)

(58) Field of Classification Search
CPC . B21D 7/04; B21D 7/02; B21D 7/022; B21D 7/024
See application file for complete search history.

(56) References Cited

U.S. PATENT DOCUMENTS

2021/0402451 A1* 12/2021 Caporusso ..... B21D 7/024

FOREIGN PATENT DOCUMENTS

| | | |
|---|---|---|
| CN | 101081416 | 12/2007 |
| CN | 101161365 | 4/2008 |
| CN | 105828967 | 8/2016 |
| CN | 113165042 | 7/2021 |
| JP | H11-077171 | 3/1999 |
| JP | 2006-502864 | 1/2006 |
| JP | 4360913 | 11/2009 |
| JP | 2012240106 | 12/2012 |
| KR | 1006614750000 | 12/2006 |
| KR | 1020080017459 | 2/2008 |
| KR | 101832170 | 2/2018 |

* cited by examiner

*Primary Examiner* — Debra M Sullivan
(74) *Attorney, Agent, or Firm* — JCIPRNET

(57) ABSTRACT

The present invention relates to a fitting bending apparatus with a pinching preventive function, and more specifically, to a fitting bending apparatus with a pinching preventive function that bends a short fitting having a length equal to or shorter than a predetermined length and has a structure in which fixing and release states of the fitting can be adjusted such that the fitting bending apparatus is not pinched between projecting portions of the fitting after bending is performed.

3 Claims, 6 Drawing Sheets

FITTING BENDING APPARATUS WITH PINCHING PREVENTIVE FUNCTION

CROSS-REFERENCE TO RELATED APPLICATION

This application is a 371 of international application of PCT application serial no. PCT/KR2022/019345, filed on Dec. 1, 2022, which claims the priority benefit of Korea application no. 10-2022-0081385, filed on Jul. 1, 2022. The entirety of each of the above mentioned patent applications is hereby incorporated by reference herein and made a part of this specification.

TECHNICAL FIELD

The present invention relates to a fitting bending apparatus with a pinching preventive function, and more specifically, to a fitting bending apparatus with a pinching preventive function that bends a short fitting having a length equal to or shorter than a predetermined length and has a structure in which fixing and release states of the fitting can be adjusted such that the fitting bending apparatus is not pinched between projecting portions of the fitting after bending is performed.

BACKGROUND ART

High-pressure fittings that are connected to pipes/high-pressure hoses which transfer high-pressure fluids and are each bent at a predetermined angle to change a direction of a pipe are available as products in various standard sizes/dimensions/sizes depending on the application.

In order to transfer a high-pressure fluid, the high-pressure fitting is made of a predetermined metal material, and a bending apparatus is used to bend a pipe having the predetermined strength.

In a case where a fitting bending apparatus of the related art bends a fitting having a short length, a fitting seating portion of the bending apparatus is pinched between projecting portions, thread formed portions, and the like of the fitting, and thus it is very difficult or impossible to release the fitting from the bending apparatus after a bending operation is finished in some cases.

In a case where the fitting can be released from the bending apparatus, a problem arises in that a fitting product may be deformed/damaged during forced release of the fitting with external force, as well as a loss of time due to the failure of quick release of the fitting in a process.

On the other hand, in the case where the fitting cannot be released from the bending apparatus, a method of manufacturing the fitting needs to be changed, and both ends (projecting portions) and a bending portion of the fitting need to be manufactured separately and then combined by performing a process of welding or the like. In this case, a very long lead time and manufacturing costs result in an increase in unit cost, and if the welding is improperly performed, a fatal problem may occur due to oil leakage. Hence, a problem arises in that an additional airtightness testing needs to be carried out to prevent the fatal problem.

SUMMARY OF INVENTION

Technical Problem

An object to be achieved by the present invention is to provide a fitting bending apparatus with a pinching preventive function that can adjust a fixing/releasing state of a fitting as desired such that the fitting can be easily detached from the apparatus after the fitting is bent in order to improve limitations of the fitting bending apparatus in the related art described above.

Solution to Problem

According to the present t invention, in order to improve limitations of the fitting bending apparatus of the related art described above, there is provided a fitting bending apparatus with a pinching preventive function that bends a fitting such that an inlet and an outlet have predetermined angles and that enables the bent fitting to be detached, the fitting bending apparatus with a pinching preventive function including: a fitting seating unit having a groove formed in a predetermined arcuate shape with a predetermined curvature such that an outer circumferential surface of the fitting is seated; a release unit having a predetermined fixing and releasing structure, which is disposed on one side of the fitting seating unit, is fixed during a process of bending the fitting, and is transported to be detached from the groove of the fitting seating unit to provide a space for the bent fitting to be detached after the process of bending the fitting; a transport shaft that provides a path along which the release unit is transported and that is disposed in a direction perpendicular to a plane including an arc forming the groove of the fitting seating unit; and an adjustment jig that is disposed above the transport shaft and adjusts switching between fixing and releasing states of the release unit. A configuration is provided in which an end portion of the fitting is fixed such that the fitting is not moved during the process of bending the fitting even when a load is applied from outside, and the end portion of the fitting is releasable after the process of bending the fitting.

In addition, the release unit may include: a seating extension portion having an extension groove forming a part of the groove of the fitting seating unit; and an independent groove structure that is disposed, as a component independent from the groove of the fitting seating unit, above the seating extension portion and has a groove formed to correspond to the extension groove in a state of being in close contact with the seating extension portion. The transport shaft may include: a support shaft fixed on one side of the seating extension portion; a spring that is connected to the support shaft and applies an elastic force upward to the independent groove structure; and a hook preventing the independent groove structure from being detached from the transport shaft.

Further, the adjustment jig may include: an adjustment body (4) that is disposed on top of the fitting seating unit, is fixed with a predetermined hinge, and is formed in a predetermined elongated shape to be rotatable around the hinge; a hook rail formed on an undersurface of the adjustment body (4) such that the hook and the adjustment body (4) do not interfere during rotation of the adjustment body (4); and a lever that is connected to one side of the adjustment body (4) and receives predetermined power such that the adjustment body (4) rotates. The release unit may include: a grip that is fixed to the independent groove structure and is stretched in a direction parallel to the transport shaft; a hook through-hole formed in the independent groove structure such that the independent groove structure is not detached from the transport shaft by the hook; and a guide through-hole that performs a predetermined guide function such that the independent groove structure does not sway in a direction other than an axial direction of the transport shaft when the independent groove structure moves in a vertical direction, and that is formed below the hook through-hole to have an inner diameter smaller than an inner diameter of the hook through-hole. The transport shaft may be configured to have a predetermined screw shape. The hook may have a configuration in which an outer diameter of the hook is larger than an outer diameter of the support shaft such that the hook functions as a head of the screw, and a height of the hook with respect to the seating extension portion is adjustable by fastening or unfastening the screw to or from the seating extension portion.

Additionally, the fitting bending apparatus with a pinching preventive function may further include a projecting-portion seating unit that is detachably fastened to both the seating extension portion and an independent groove structure and has a predetermined groove in which a projecting portion of the fitting is seated. A configuration may be provided in which fittings having different standard sizes or dimensions are to be bent by a single apparatus by replacing the projecting-portion seating unit depending on a size of the fitting.

Advantageous Effects of Invention

According to an embodiment of the present invention, it is possible to prevent a phenomenon in which the bending apparatus is pinched in a space between projecting portions of the fitting after a high-pressure fitting is bent.

In addition, it is possible to configure a bending apparatus that can use fittings having various standard sizes/dimensions.

Further, since a bent fitting can be easily detached from the bending apparatus, the fitting can be prevented from being deformed and damaged.

DESCRIPTION OF EMBODIMENTS

Figure 1:
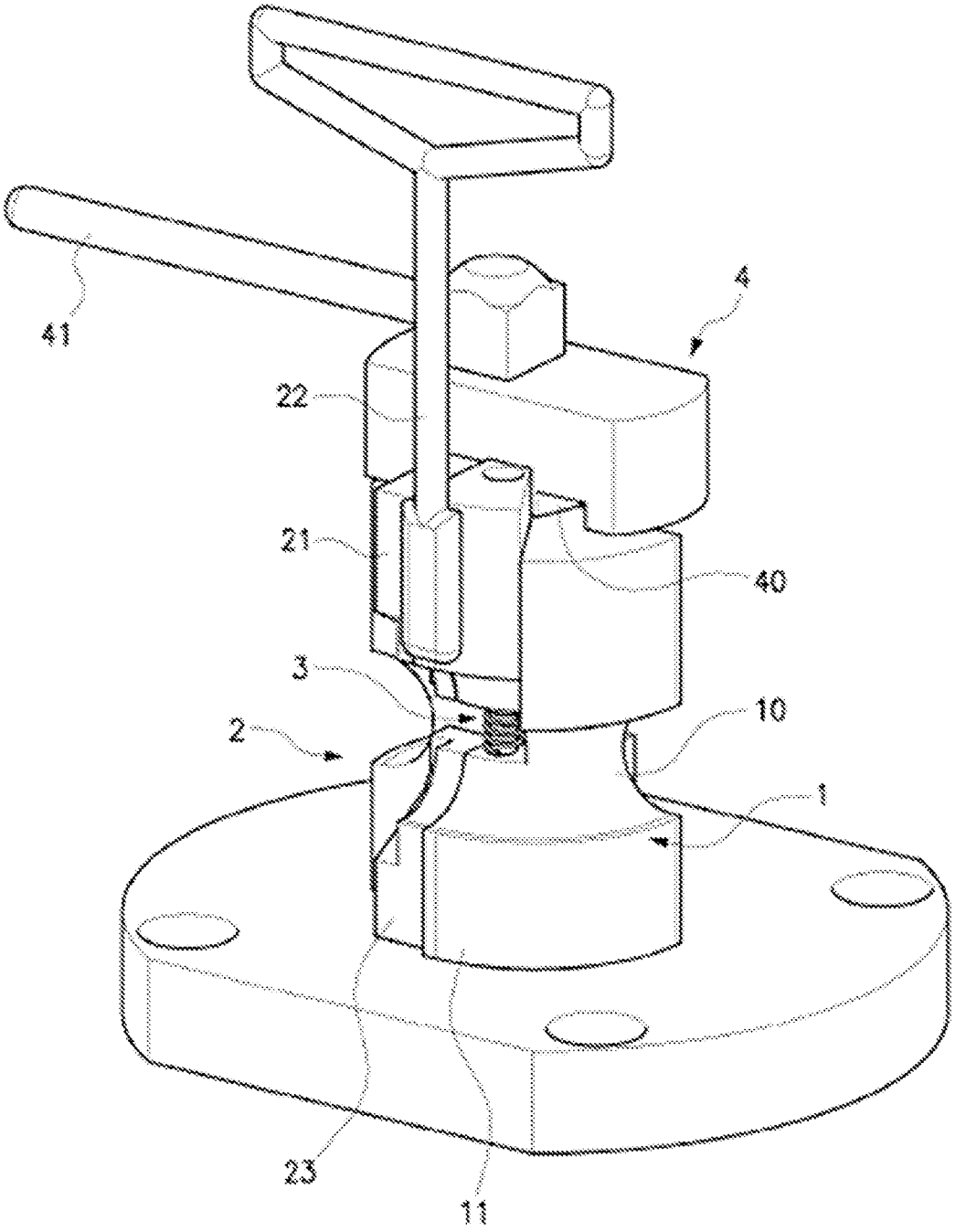
FIGS. 1 to 4 are perspective views illustrating a fitting bending apparatus with a pinching preventive function according to an embodiment of the present invention.

Hereinafter, various embodiments of this document will be described with reference to the accompanying drawings. However, a technology described in this document is not limited to a specific example, but is to be understood to include various modifications, equivalents, and/or alternatives of the embodiments of this document. Regarding the description of the drawings, similar reference signs can be assigned to similar configurational elements.

In this document, expressions such as "comprise" or "may comprise" refer to presence of a feature (for example, numerical value, function, operation, or configurational element such as a component) and does not exclude presence of an additional feature.

In this document, an expression such as "one or more of A or/and B" can include all possible combinations of listed items. For example, "A or B", and "one or more of A and B" can refer to three cases of (1) including at least one A, (2) including at least one B, and (3) including both at least one A and at least one B.

A case where one configurational element (for example: first configurational element) is "(operatively or communicatively) coupled with/to" or "connected to" another configurational element (for example: second configurational element) will be understood to mean that the one configurational element and the other configurational element can be directly coupled with/to each other or can be coupled with/to each other through still another configurational element (for example: third configurational element).

Terms used in this document are only used to describe a specific embodiment and are not intentionally used to limit the scope of another embodiment. Words having singular forms can include a meaning of their plural forms unless obviously implied otherwise in context.

Terms used herein including technical or scientific terms can have the same meanings as meanings generally understood by those of ordinary skill in the art described in this document. Of the terms used in this document, terms defined in general dictionaries can be construed to have the same or similar meanings as the contextual meanings in the related art. In addition, unless clearly defined in this document, the terms should not be construed to have ideal or excessively formal meanings. In some cases, the terms defined in this document cannot be construed to exclude the embodiment of this document.

It is needless to say that various modified examples of the present invention can be made by a person of ordinary skill in the art to which the corresponding invention pertains without departing from the gist of the present invention claimed in Claims of the present invention, and the various modified examples are not to be understood separately from the technical ideas or prospects of the present invention.

Terms such as "upper portion", "top", "perpendicular", "parallel", or the like used in the following description of the invention are defined based on the drawings, and a shape and a position of each configuration is not limited thereto by the terms.

Words having singular forms used in this specification is also construed to have a meaning of their plural forms unless obviously construed otherwise in context. A term such as "to comprise" is to be construed to mean that a feature, the number, a step, an operation, a configurational element, a part, or a combination thereof realized here is present and not to exclude presence or a possibility of addition of one or more additional features, numbers, steps, operations, configurational elements, parts, or combinations thereof.

According to the embodiment of the present invention, there is provided a fitting bending apparatus with a pinching preventive function that bends a fitting 5 such that an inlet 51 and an outlet 51 have predetermined angles and that enables the bent fitting 5 to be detached, the fitting bending apparatus with a pinching preventive function including: a fitting seating unit 1 having a groove (fitting groove; 10) formed in a predetermined arcuate shape with a predetermined curvature such that an outer circumferential surface of the fitting 5 is seated; a release unit 2 having a predetermined fixing and releasing structure, which is disposed on one side of the fitting seating unit 1, is fixed during a process of bending the fitting 5, and is transported to be detached from the groove of the fitting seating unit 1 to provide a space for the bent fitting 5 to be detached after the process of bending the fitting 5; a transport shaft 3 that provides a path along which the release unit 2 is transported and that is disposed in a direction perpendicular to a plane including an arc forming the groove 10 of the fitting seating unit 1; and an adjustment jig 4 that is disposed above the transport shaft 3 and adjusts switching between fixing and releasing states of the release unit 2. A configuration is provided in which an end portion of the fitting 5 is fixed such that the fitting 5 is not moved during the process of bending the fitting 5 even when a load is applied from outside, and the end portion of the fitting 5 is releasable after the process of bending the fitting 5.

In the description provided above, the 'inlet and outlet' 51 are terms used to distinguish between two different holes of the fitting 5, and a direction in which a fluid flows when the fitting 5 is used does not limit a configurational element of the present invention.

The 'groove having a predetermined curvature (fitting groove; 10)' may be formed to have a curvature equal to or larger than a curvature of an outer diameter of the fitting 5 such that an outer diameter of the fitting 5 to be bent can be seated.

The 'predetermined arc' of the fitting seating unit 1 may be configured to have a center angle of 60 degrees to 180 degrees. According to the center angle, a product having a bending angle of 90 degrees of the fitting 5 ("L"-shaped fitting 5) to a product of 180 degrees ('U'-shaped fitting 5) can be manufactured (bent) as needed.

On the opposite side of the fitting seating unit 1 (opposite with respect to a center point of the predetermined arc), a load support 12 can be formed. The load support 12 performs a function of withstanding a load applied to the fitting seating unit 1 through the fitting 5 in a bending process. More specifically, a moment applied to a position where the fitting seating unit 1 is connected, due to the load applied to the fitting seating unit 1 is reduced to prevent damage to the device, and the bending process can be performed with a larger load.

Alternatively, a groove having the predetermined curvature (second fitting groove) is formed in the load support 12, but with a curvature different from that of the groove (first fitting groove; 10) having a predetermined curvature formed in the fitting seating unit 1, so that a configuration can be provided in which fittings 5 having respective different outer diameters are bent by one apparatus. However, in this case, the release unit 2, the transport shaft 3, the adjustment jig 4, which are the configurational elements of the present invention, should be arranged in the load support 12 in the same manner, and the configurational elements should be appropriately arranged such that the configurational elements do not interfere with each other. Since this configuration is within the scope in which the configuration can be easily carried out with reference to the description of the present invention, the more specific description is omitted.

In addition, the release unit 2 can include: a seating extension portion 11 having an extension groove 110 forming a part of the groove of the fitting seating unit 1; and an independent groove structure 21 that is disposed, as a component independent from the groove of the fitting seating unit 1, above the seating extension portion 11 and has a groove formed to correspond to the extension groove 110 in a state of being in close contact with the seating extension portion 11. The transport shaft 3 can include: a support shaft 30 fixed on one side of the seating extension portion 11; a spring 31 that is connected to the support shaft 30 and applies an elastic force upward to the independent groove structure 21; and a hook 32 preventing the independent groove structure from being detached from the transport shaft 3.

The seating extension portion 11 can be formed, for the fitting groove 10 having a semicircular cross section, by extending from a part (lower portion) having a ¼ circular (arc having a center angle of 90 degrees) cross section or can be configured by adding a member having the shape as described above.

According to this structure, the fitting 5 is seated in the fitting groove 10 (half of the fitting is inserted into the semicircular groove), and only a portion corresponding to one fourth of the end portion of the fitting 5 is seated by the seating extension portion 11.

In this regard, when the independent groove structure 21 is in close contact with the upper portion of the seating extension portion 11, the remaining one fourth of the end portion of the fitting 5 is seated, and the end portion of the fitting 5 can be fixed (seated) between the seating extension portion 11 and the independent groove structure 21.

The support shaft 30 can be connected to the spring 31 in parallel or in series. FIGS. 1 to 6 of the present invention illustrate an embodiment in which the support shaft 30 and the spring 31 are connected in parallel (a state in which the support shaft 30 is inserted into an inner side of the spring 31). In an embodiment in which the support shaft 30 and the spring 31 are connected in series, a function of adjusting a height of the hook 32 by screw fastening of the support shaft 30 to be described below is not provided.

Further, the adjustment jig 4 can include an adjustment body 4 that is disposed on top of the fitting seating unit 1, is fixed with a predetermined hinge, and is formed in a predetermined elongated shape to be rotatable around the hinge; a hook rail 40 formed on an undersurface of the adjustment body 4 such that the hook 32 and the adjustment body 4 do not interfere during rotation of the adjustment body 4; and a lever 41 that is connected to one side of the adjustment body 4 and receives predetermined power such that the adjustment body 4 rotates. The release unit 2 can include: a grip 22 that is fixed to the independent groove structure 21 and is stretched in a direction parallel to the transport shaft 3; a hook through-hole 211 formed in the independent groove structure 21 such that the independent groove structure 21 is not detached from the transport shaft 3 by the hook 32; and a guide through-hole 212 that performs a predetermined guide function such that the independent groove structure 21 does not sway in a direction other than an axial direction of the transport shaft 3 when the independent groove structure 21 moves in a vertical direction, and is formed below the hook through-hole 211 to have an inner diameter smaller than an inner diameter of the hook through-hole 211. The transport shaft 3 is formed in a predetermined screw shape. The hook 32 can have a configuration in which an outer diameter of the hook 32 is larger than an outer diameter of the support shaft 30 such that the hook 32 functions as a head of the screw, and a height of the hook 32 with respect to the seating extension portion 11 is adjustable by fastening or unfastening the screw to or from the seating extension portion 11.

In the description provided above, the 'elongated shape' can mean a shape having a predetermined length or/and a shape having a predetermined eccentricity. For example, the 'elongated shape' may include a shape of a member or a cam having an oval or rectangular (embodiment illustrated in the drawing) cross section and a shape of a member having a circular or square cross section in which a position (rotating axis) connected to a hinge is separated from a body thereof.

The lever 41 and the grip 22 can be manipulated by a hand of an operator participating in the process or automatically operated by an automation device or the like.

When the operator manipulates the lever and the grip by hand, the lever 41 can be manipulated to change the fixing and releasing state while the grip 22 is held and pressed by hand.

It is preferable to form the outer diameter of the hook 32 smaller than the inner diameter of the hook through-hole 211 by a predetermined size, and form the outer diameter of the support shaft 30 smaller than the inner diameter of the guide through-hole 212 by a predetermined size.

The adjustment body 4, which moves up and down through the hook through-hole 211 and the guide through-hole 212, has a limitation in upper height by the hook 32 being hooked at a step formed at a position between the hook through-hole 211 and the guide through-hole 212.

Figure 4:
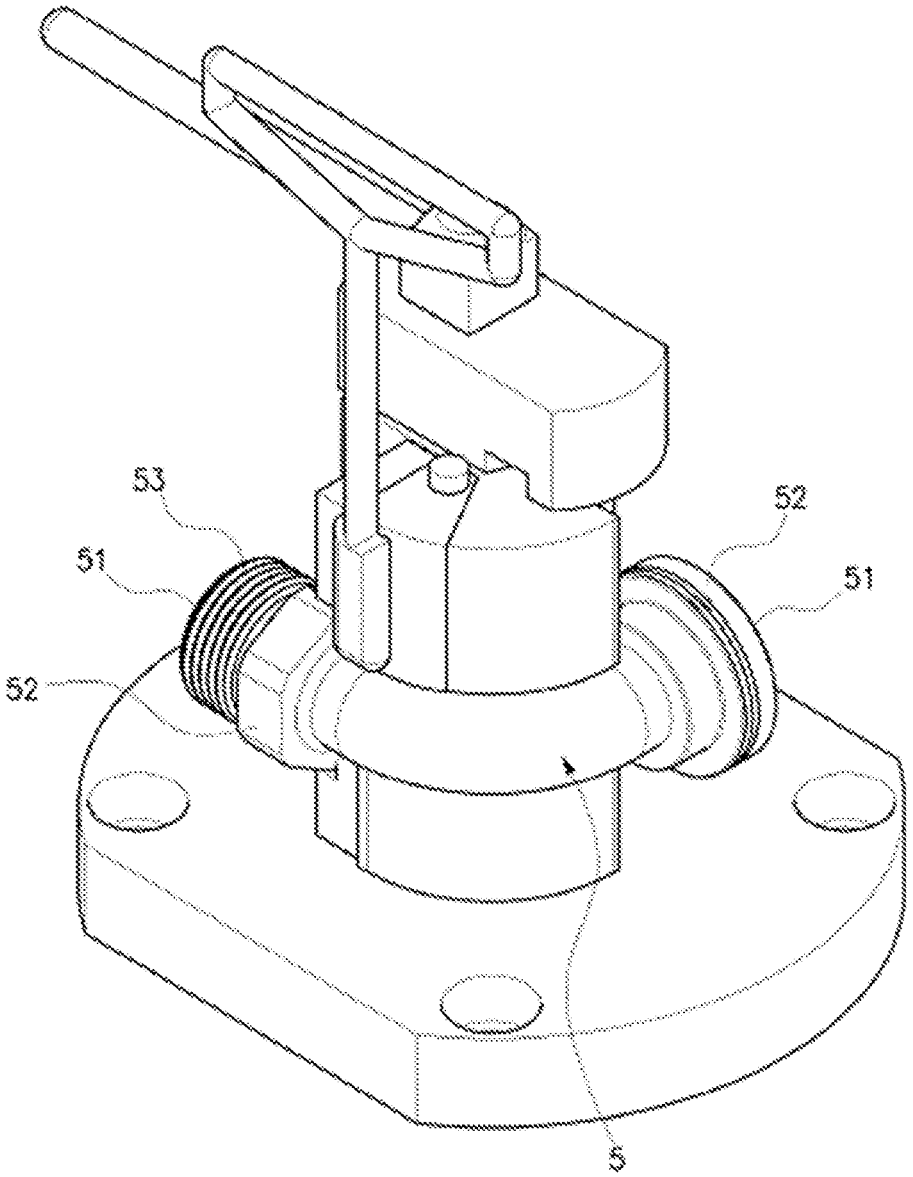
Figure 5:
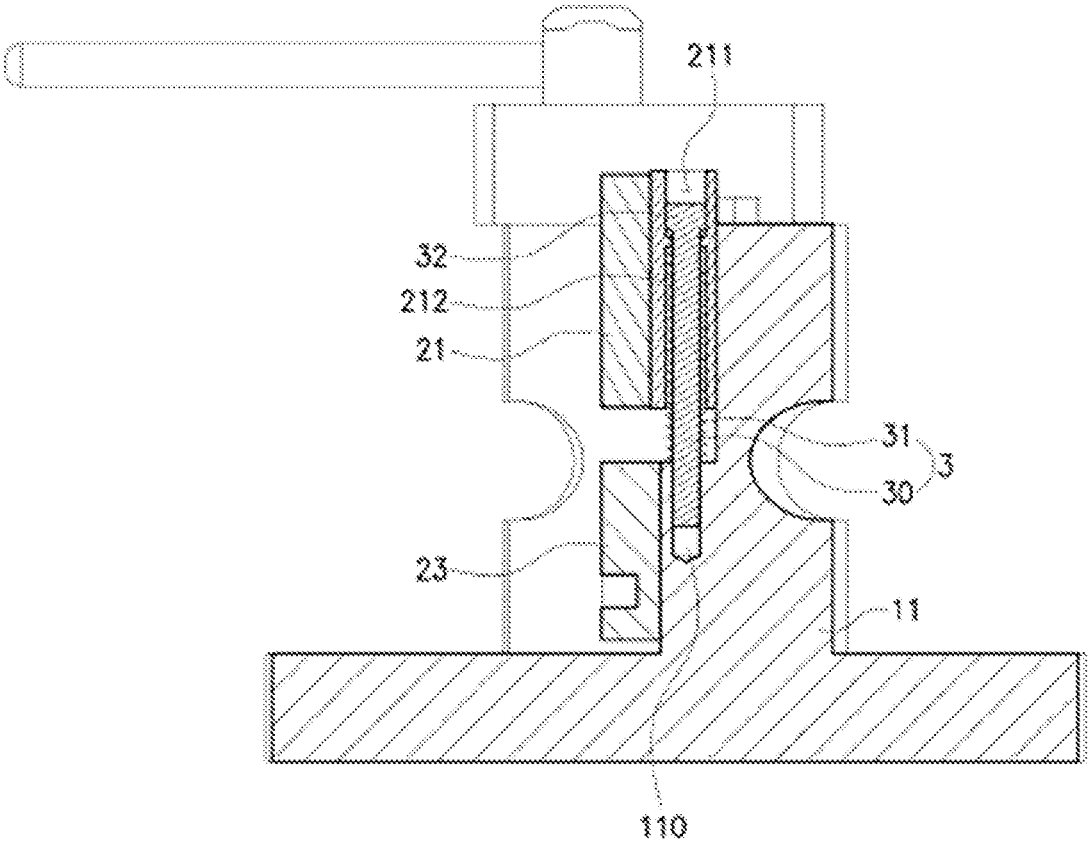
FIG. 5 is a sectional view illustrating a part of the fitting bending apparatus with a pinching preventive function according to the embodiment of the present invention.

Alternatively, a configuration can be provided in which the hook through-hole 211 and the guide through-hole 212 have the same inner diameter and a predetermined step is formed between the hook through-hole 211 and the guide through-hole 212. The embodiment illustrated in FIG. 4 is an embodiment in which the hook through-hole 211 and the guide through-hole 212 have the same inner diameter as described above.

Additionally, the fitting bending apparatus with a pinching preventive function may further include a projecting-portion seating unit 23 that is detachably fastened to both the seating extension portion 11 and an independent groove structure 21 and has a predetermined groove 230 in which a projecting portion 52 of the fitting 5 is seated. A configuration may be provided in which fittings 5 having different standard sizes or dimensions are to be bent by a single apparatus by replacing the projecting-portion seating unit 23 depending on a size of the fitting 5.

The projecting-portion seating unit 23 can be detachably fastened to a side surface of an end portion of the seating extension portion 11 and a side surface of the independent groove structure 21 through a predetermined screw/bolt, or the like.

Figure 2:
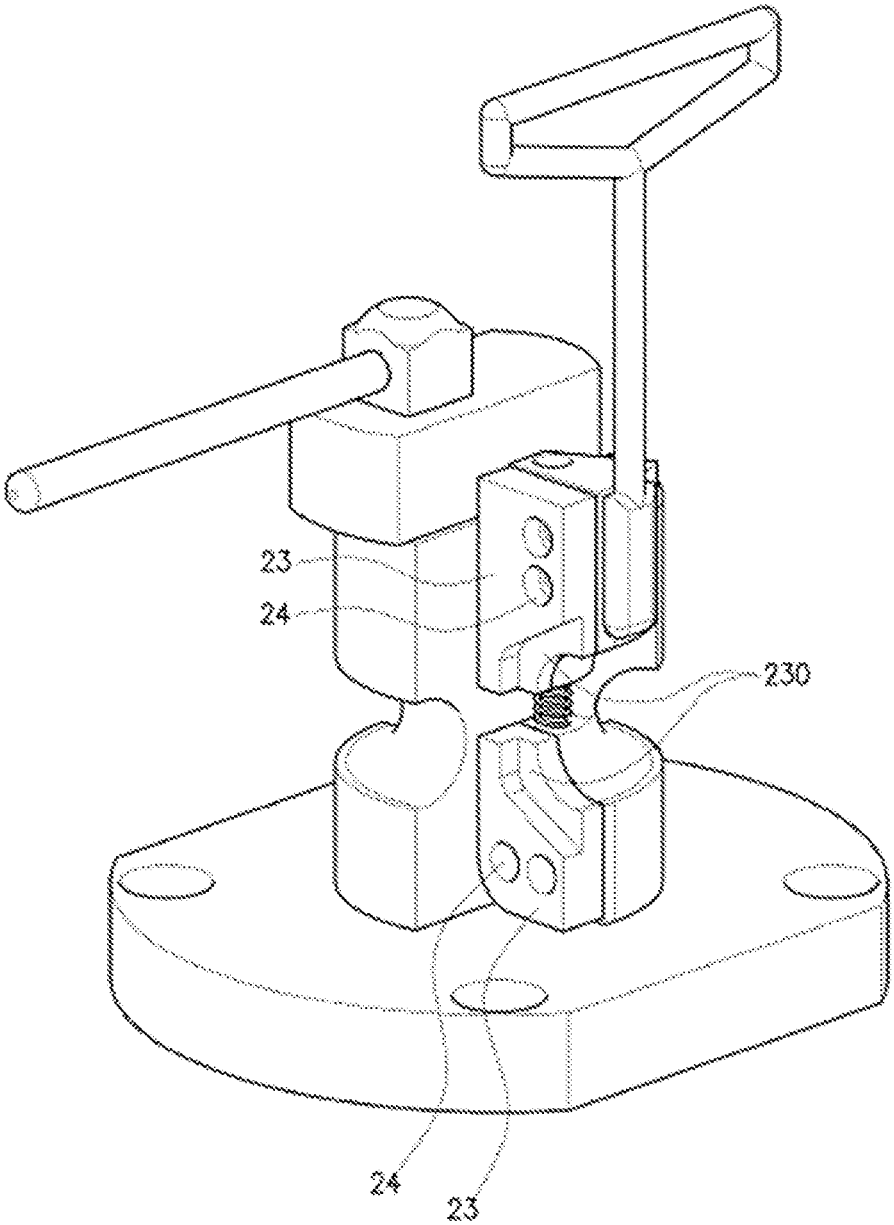
Figure 3:
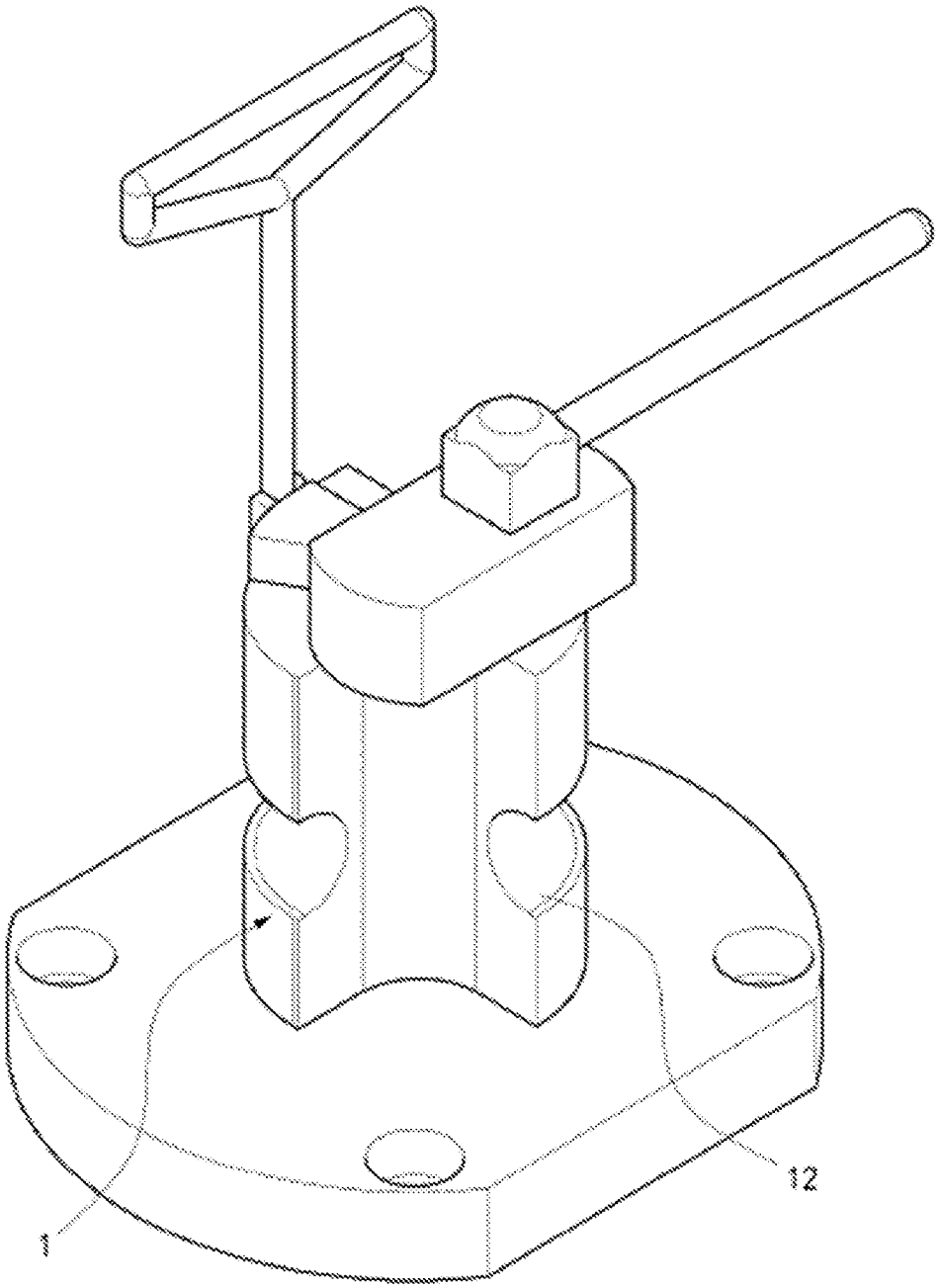

The projecting-portion seating unit 23 can be formed to seat/fix any one of the projecting portions 52 of the fitting 5 and can be formed to have a predetermined polygonal shape corresponding to the projecting portion 52 to seat the projecting portion 52 having a predetermined polygonal shape like a bolt head. FIG. 2 illustrates an embodiment in which the projecting-portion seating unit 23 having a predetermined trapezoidal shape is formed to seat the fitting 5 having the hexagonal projecting portion 52.

According to such a structure described above, even when the outer diameter of the fitting 5 is smaller than a diameter of the fitting groove 10, a tangent part parallel to a central axis of the fitting 5 comes into close contact with the fitting groove 10 and is bent to be supported by/fixed to the fitting seating unit 1 such that a load can be transferred to the fitting from a bend die.

In addition, there is provided a method for manufacturing a fitting by using the fitting bending apparatus with a pinching preventive function described above, the method including: a step coupling a bush to a thread 53 of the fitting 5; a step of seating the fitting 5 in the fitting seating unit 1; a step of fixing the fitting 5 by using the adjustment jig 4; a step of inserting a fixed shaft into the fitting 5 on one side; a step of causing a clamp to come into contact with the bush; a step of rotating the bend die to apply a load such that a part to which the bush is coupled is bent with respect to a part fixed by the fixed shaft; a step of retracting the fixed shaft and clamp; a step of releasing the fitting 5 from the fitting seating unit 1 by using the adjustment jig 4; and a step of releasing the bush from the fitting 5.

The clamp can include a first clamp supporting any one projecting portion 52 of the fitting 5 and a second clamp supporting the bush and can bend the fitting 5 around a center of the fitting groove 10 by rotating the bend die in a state where the first clamp and the second clamp are fixed.

Hereinafter, a bending process will be described with reference to FIG. 6.

Figure 6:
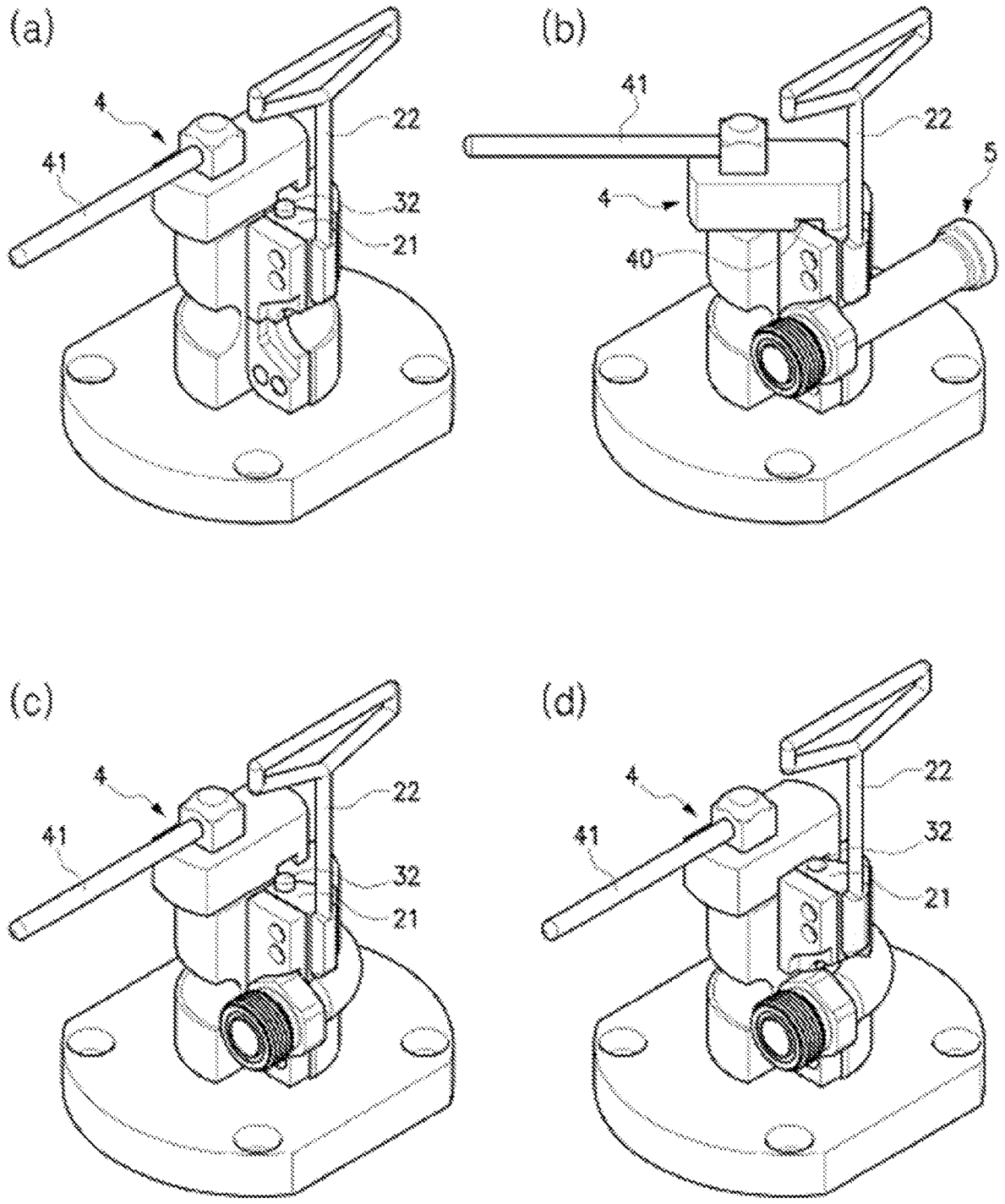
FIG. 6 is a view illustrating a process of bending a fitting in accordance with a method for manufacturing a fitting according to the embodiment of the present invention.

First, as illustrated in (a) of FIG. 6, in a state where the independent groove structure 21 is brought in close contact with the seating extension portion 11 by using the grip 22, the adjustment body 4 is rotated through the lever 41 to fix the independent groove structure 21. In this case, the hook 32 is accommodated inside the adjustment body 4 along the hook through-hole 211.

Thereafter, as illustrated in (b) of FIG. 6, the fitting 5 to which the bush is coupled is seated in the fitting seating unit 1. In the seated state, the clamp is advanced to fix the bush and the projecting portion 52 on the other end or the body of the fitting 5.

Next, as illustrated in (c) of FIG. 6, in a state where the fitting 5 is fixed, the bend die to which one of the clamps is connected is rotated (can be rotated around a center point of the 'predetermined arc') to apply a predetermined load such that the fitting 5 is bent. After the bending is completed, the clamp is retracted again.

Finally, as illustrated in (d) of FIG. 6, the release unit 2 is operated to easily release the fittings. The bent fitting 5 is taken out from the fitting seating unit 1.

The invention claimed is:

1. A fitting bending apparatus with pinching preventive function that bends a fitting such that an inlet and an outlet have predetermined angles and that enables a bent fitting to be detached, the fitting bending apparatus with pinching preventive function comprising:

a fitting seating unit having a groove formed in a predetermined arcuate shape with a predetermined curvature such that an outer circumferential surface of the fitting is seated;

a release unit having a predetermined fixing and releasing structure, which is disposed on one side of the fitting seating unit, is fixed during a process of bending the fitting, and is transported to be separated from the groove of the fitting seating unit to provide a space for the bent fitting to be detached after the process of bending the fitting;

a transport shaft that provides a path along which the release unit is transported and that is disposed in a direction perpendicular to a plane including an arc forming the groove of the fitting seating unit; and an adjustment jig that is disposed above the transport shaft and adjusts switching between fixing and releasing states of the release unit, wherein the end portion of the fitting is releasable after the process of bending the fitting, wherein the release unit includes:

a seating extension portion having an extension groove forming a part of the groove of the fitting seating unit; and an independent groove structure that is disposed, as a component independent from the groove of the fitting seating unit, above the seating extension portion and has a groove formed to correspond to the extension groove in a state of being in close contact with the seating extension portion, and wherein the transport shaft includes:

a support shaft fixed on one side of the seating extension portion;

a spring that is connected to the support shaft and applies an elastic force upward to the independent groove structure; and a hook preventing the independent groove structure from being detached from the transport shaft.

2. The fitting bending apparatus with pinching preventive function according to claim 1, wherein the adjustment jig includes:

an adjustment body that is disposed on top of the fitting seating unit, is fixed with a predetermined hinge, and is formed in a predetermined elongated shape to be rotatable around the hinge;

a hook rail formed on an undersurface of the adjustment body such that the hook and the adjustment body do not interfere during rotation of the adjustment body; and a lever that is connected to one side of the adjustment body and receives predetermined power such that the adjustment body rotates, wherein the release unit includes:

a grip that is fixed to the independent groove structure and is stretched in a direction parallel to the transport shaft;

a hook through-hole formed in the independent groove structure such that the independent groove structure is not detached from the transport shaft by the hook; and a guide through-hole that performs a predetermined guide function such that the independent groove structure does not sway in a direction other than an axial direction of the transport shaft when the independent groove structure moves in a vertical direction, and is formed below the hook through-hole to have an inner diameter smaller than an inner diameter of the hook through-hole, wherein the transport shaft comprises a screw, and wherein the hook has a configuration in which: an outer diameter of the hook is larger than an outer diameter of the support shaft such that the hook functions as a head of the screw, and a height of the hook with respect to the seating extension portion is adjustable by fastening or unfastening the screw to or from the seating extension portion.

3. The fitting bending apparatus with pinching preventive function according to claim 1, further comprising:

a projecting-portion seating unit that is detachably fastened to both the seating extension portion and the independent groove structure and has a predetermined groove in which a projecting portion of the fitting is seated.

* * * * *